United States Patent [19]

Parker et al.

[11] Patent Number: 4,926,837

[45] Date of Patent: May 22, 1990

[54] COOKING OVENS

[75] Inventors: Christopher Parker, Chester; Gordon T. Andrews, Bromley, both of England

[73] Assignee: New World Domestic Appliances Limited, Warrington, United Kingdom

[21] Appl. No.: 371,793

[22] Filed: Jun. 27, 1989

[30] Foreign Application Priority Data

Jun. 28, 1988 [GB] United Kingdom ..... 8815381

[51] Int. Cl.[5] ..... F24C 15/32

[52] U.S. Cl. ..... 126/21 A; 219/10.55 R; 219/400

[58] Field of Search ..... 126/21 A, 273 R, 273 A; 219/10.55 R, 400

[56] References Cited

U.S. PATENT DOCUMENTS

| | | | |
|---|---|---|---|
| Re. 31,637 | 7/1984 | Yoshida et al. | 219/10.55 R |
| 4,278,862 | 7/1981 | Mizuno et al. | 219/10.55 R |
| 4,283,614 | 8/1981 | Tanaka et al. | 219/400 |

FOREIGN PATENT DOCUMENTS

| | | | |
|---|---|---|---|
| 2105459 | 9/1981 | United Kingdom | 219/400 |

*Primary Examiner*—Carroll B. Dority

*Attorney, Agent, or Firm*—Shlesinger & Myers

[57] ABSTRACT

A cooking oven, preferably in the form of a gas combination microwave oven comprises a gas burner 8 affording a source of convected heat and an electrical heating element 10 both of which are used to reduce the initial warm-up time of the oven.

11 Claims, 2 Drawing Sheets

COOKING OVENS

This invention relates to cooking ovens and is especially applicable to combination microwave cooking ovens.

A combination microwave cooking oven combines the advantages of a microwave oven and a normal gas or electric convection oven, by incorporating into the microwave oven either an electric heater or a gas burner. An internal fan may also be provided to afford the advantages of a fanned oven.

One drawback with such a combination microwave cooking oven is that whereas the microwave energy is available immediately for cooking, it can take up to approximately 15 minutes for the electric heater or the gas burner, as the case may be, to heat the oven to the required temperature. In conventional cooking ovens also, this warm-up time may be in the order of 15 minutes which is undesirably long.

It is an object of the present invention to provide a cooking oven in which this warm-up time is reduced.

According to the present invention there is provided a cooking oven comprising an oven cavity, a gas burner for heating said oven cavity, and an electric heater for heating said oven cavity, it being arranged that during a warm-up period said gas burner and said electric heater are both used for heating said oven cavity.

In a preferred arrangement in accordance with the present invention, the cooking oven will take the form of a combination microwave oven comprising a source of microwave energy for said cavity, and it may be arranged that when a required oven temperature has been reached said electric heater is de-energised and said source of microwave energy is energised.

In one form of cooking oven in accordance with the present invention, a fan will be provided for circulating hot air in said oven cavity.

Advantageously, said fan is disposed in the rear wall of said oven cavity, and is effective for withdrawing air directly from said oven cavity and for re-introducing said air to said oven cavity via one or more air vents in said rear wall.

Conveniently, the gas burner may be provided in the floor of said oven cavity, adjacent said rear wall, and a gas burner chimney may be provided around said burner, to direct heated air to the vicinity of said fan.

Advantageously, said electric heater may be disposed around said fan, in the path of the circulating hot air.

An exemplary embodiment of the invention will now be described, reference being made to the accompanying drawings, in which.

Figure 1:
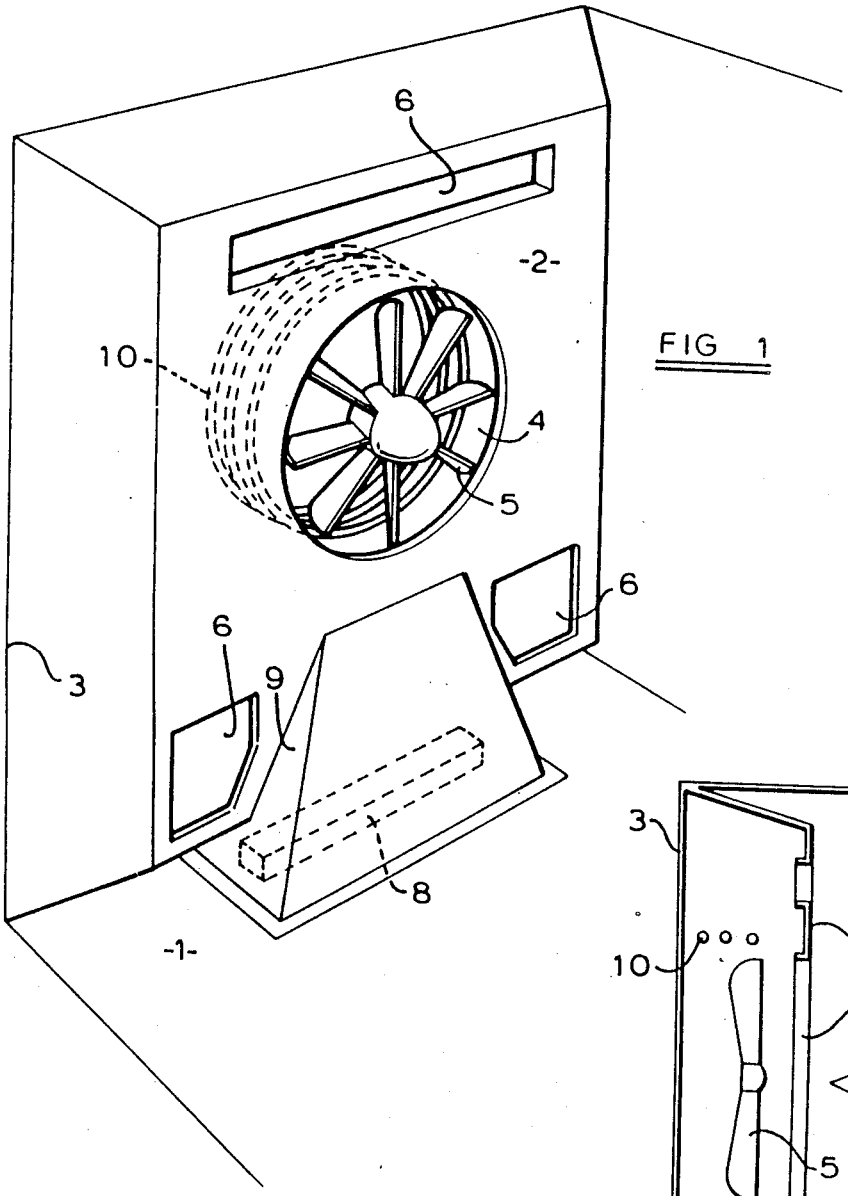
FIG. 1, is a diagrammatic view of the rear part of an oven cavity of a gas combination microwave oven in accordance with the present invention.
Figure 2:
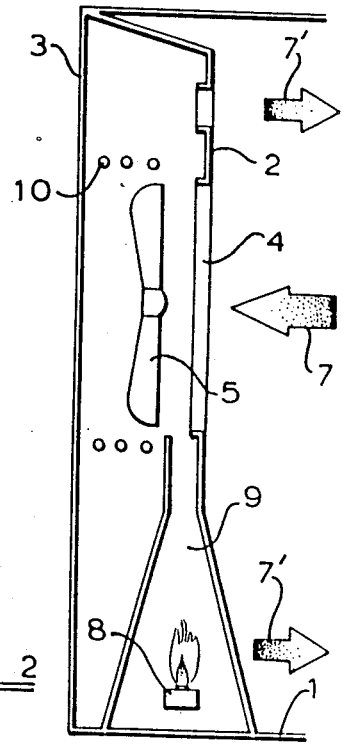
FIG. 2, is a cross-sectional side view of the rear part of FIG. 1.

In FIGS. 1 and 2 of the drawings, there is shown the rear part of an oven cavity or oven compartment of a gas combination microwave oven, this consisting of a floor section 1 from the rear edge of which extends upwardly a rear wall 2. Spaced from the rear wall 2 is the rear casing between which is formed a heating compartment 3 of the microwave oven.

In the centre of the rear wall 2 is provided a circular vent 4 behind which is disposed a fan 5 which draws air from the oven cavity through the vent 4, as depicted by the arrow 7 in FIG. 2, into the space between the rear wall 2 and the rear casing 3, and which re-introduces the air into the oven cavity via three peripherally positioned air vents 6, as depicted by the arrows 7' in FIG. 2.

In practice the circular vent 4 and the air vents 6 will be formed as a series of small holes, the size of which is chosen so that they afford a block to microwave radiation, thereby protecting the fan 5 and other components located behind the rear wall 2.

In the floor 1 of the oven cavity, adjacent the rear wall 2, is disposed a gas burner 8 which is provided with a chimney 9 formed by a baffle and wall 2, formed in part by the rear wall 2, which directs products of combustion from the gas burner to the vicinity of the fan 5, by means of which they are included in the circulated air stream.

For convenience, the microwave energy source which would normally be associated with the oven cavity is not shown.

As has already been explained, if the gas burner 8 is relied upon to heat the oven cavity to the required temperature, then a warm-up time of approximately 15 minutes is often required. In order to substantially reduce this warm-up time, an electrical "booster" coiled heating element 10 is provided, disposed around the periphery of the fan 5 and in the path of the circulating air.

It is arranged that when the microwave oven is first operated, the gas burner 8 is ignited and the electrical heating element 10 is energised, but not the microwave energy source. With both sources of convection heat operating, the oven warm-up time is substantially reduced, typically to approximately 5 or 6 minutes. When the required oven temperature is reached, the electrical heating element 10 is de-energised and the microwave energy source is energised. The oven then operates as a conventional gas combination microwave oven.

Figure 3:
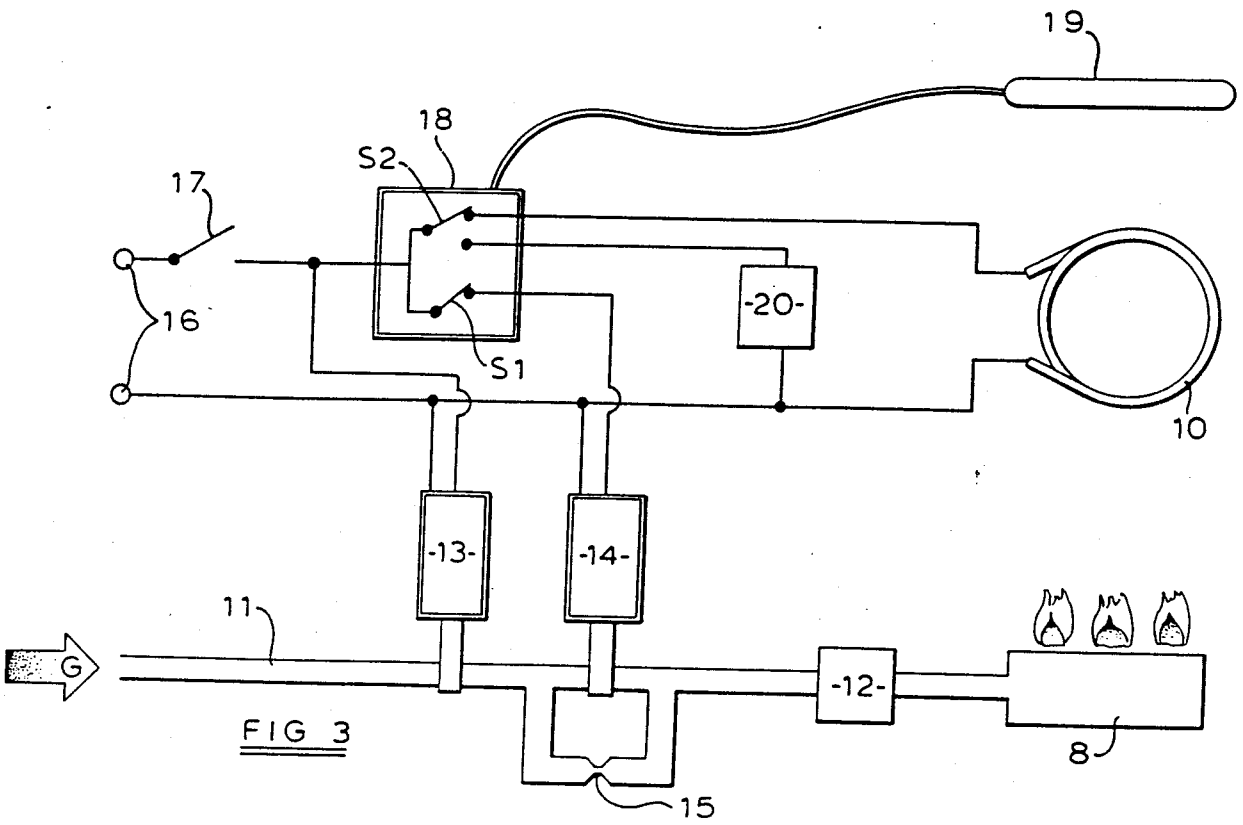
FIG. 3 is a diagrammatic representation of a control system for the oven of FIG. 1.

In FIG. 3 of the drawings there is shown a control system for controlling the various elements of the gas combination oven depicted in FIGS. 1 and 2. In FIG. 3 the gas burner 8 is shown which is supplied with gas G via a gas rail 11 which includes a flame failure device 12 of known form. The gas rail 11 is provided with a main, solenoid operated ON/OFF valve 13 for controlling gas flow to the burner 8, and also a further solenoid operated valve 14 which is provided with a by-pass restriction 15 whereby the gas flow to the gas burner 8 can be controlled between full on and a minimum flow rate determined by the restriction 15 which is sufficient to maintain the gas burner alight.

The solenoid valves 13 and 14 are operated from an alternating current supply (not shown) connected to input terminals 16 of the control system, via an ON/-OFF switch 17. The main solenoid valve 13 is connected directly to the switch 17 whereas the solenoid valve 14 is connected to the switch 17 via twin switched thermostat 18 which is provided with a heat sensitive phial 19 which is positioned at some suitable position in the oven cavity of the gas combination microwave oven in FIG. 1. The twin switched thermostat 18 may be of adjustable form and is provided with a normally closed switch S1 which connects the solenoid valve 14 to the ON/OFF switch 17, and also a changeover switch S2 which normally connects the "booster" heating element 10 to the ON/OFF switch 17, but which in the switched condition of the thermostat 18 connects the microwave energy source 20 to the ON/OFF switch 17. It is arranged within the thermostat 18 that the switch S2 actuates at a lower temperature e.g. by 20° C. than the switch S1. Thus, typically, switch S2 may have a range of 0° to 230° C. and switch S1 may have a range of 0° to 250° C.

The control system of FIG. 3 operates as follows:

When the ON/OFF switch is closed, solenoid valve 13 will open and also solenoid valve 14 will open due to the normally closed switch S1, so that the gas is supplied to the gas burner 8. At the same time the "booster" heating element 10 is connected to the ON/OFF switch 17 via the switch S2. Thus the oven cavity will be heated by the gas burner 8 and by the "booster" heater element 10.

When the phial 19 of the thermostat 18 detects that the temperature of the oven cavity is within 20° C. of the required temperature, the switch S2 of the thermostat 18 operates to disconnect the "booster" heater element 10 from the ON/OFF switch 17 and to connect the microwave energy source 20 to the ON/OFF switch 17.

The oven cavity continues to be heated by the gas burner 8 until the required oven temperature is reached, at which time the switch S1 of the thermostat 18 is operated to cause the solenoid valve 14 to close to restrict the gas flow to the burner 8 to that defined by the by-pass restriction 15.

The oven then operates as a conventional gas combination microwave oven, the gas burner 8 being operated if the oven cavity temperature falls appreciably. It will be appreciated, however, that during the warm-up period of the oven, both the gas burner 8 and the "booster" heater element 10 are energised, thereby substantially reducing the warm-up time.

Although especially applicable to combination microwave ovens, the feature of providing a "booster" heating element may also be used in conventional gas or electric cooking ovens, in order to reduce the warm-up time. Thus, in a gas cooking oven, an electrical "booster" heating element may be provided to reduce the warm-up time, and in an electrical cooking oven, a gas burner "booster" may be provided for reducing the warm-up time.

What is claimed:

1. A cooking oven comprising:

(a) oven means including a back wall, a bottom wall and a top wall, (b) a second wall spaced from said back wall and extending from the bottom wall to the top wall of said oven means and forming with said back wall a heating compartment, (c) said heating compartment including an electric heating means and a gas heating means, (d) a fan means in said heating compartment, (e) an intake vent in said second wall in proximity to said fan means, (f) output vents in said wall spaced above and below said intake vent, (g) a baffle extending upwardly from the bottom wall of said oven means in said heating compartment and spaced between said back wall and said second wall and extending upwardly to said intake vent, (h) said gas heating means positioned between said baffle and said second wall adjacent said oven bottom wall, (i) said baffle including an inside facing said second wall and an outside facing said back wall, (j) said electric heating means positioned at the outside of said baffle, (k) said oven including microwave means, and (l) means for automatically controlling said electric heating means, said gas heating means and said microwave heating means.

2. The oven means of claim 1, further comprising:

(a) temperature sensing control means for sequentially operating said gas heating means, and said electric heating means and said microwave means.

3. The oven means of claim 1, further comprising:

(a) control means for simultaneously operating said gas heating means, said electric heating means and said microwave means.

4. The oven means of claim 1, wherein:

(a) said electric heating means includes a plurality of coils, (b) said coils are disposed around said fan means in the path of air circulated by said fan, further comprising: air circulated by said fan means will flow between said coils.

5. The oven means of claim 1, further comprising:

(a) temperature regulating means for regulating heat output of said oven compartment heating means according to temperature, and (b) said temperature regulating means including means for activating said microwave cooking means and simultaneously de-activating said electric heating means when a predetermined oven compartment temperature is reached.

6. A cooking oven comprising:

(a) means forming an oven cavity, (b) said oven cavity including electric heating means for heating said oven cavity, (c) said oven cavity further including gas heating means for heating said oven cavity, (d) said oven cavity further including a source of microwave energy, (e) oven control means for effecting simultaneous energization of said electric heating means and said gas heating means during an initial warm-up period of said oven, and (f) temperature regulating means operable when said oven cavity has attained a pre-determined temperature for de-energizing said electric heating means and energizing said source of microwave energy.

7. A cooking oven as claimed in claim 6, comprising a fan for circulating hot air in said oven cavity.

8. A cooking oven as claimed in claim 7, in which said fan is disposed in a rear wall of said oven cavity, and is effective for withdrawing air directly from said oven cavity and is effective for re-introducing said air to said oven cavity via one or more air vents in said rear wall.

9. A cooking oven as claimed in claim 8, in which the gas burner is provided in a floor of an oven housing, adjacent said rear wall.

10. A cooking oven as claimed in claim 9, in which means forming a gas burner chimney is provided around said burner, to direct hot gases to the vicinity of said fan.

11. A cooking oven as claimed in claim 7, in which said electric heater is disposed around said fan.

* * * * *